US011844424B2

(12) United States Patent
Kay

(10) Patent No.: US 11,844,424 B2
(45) Date of Patent: Dec. 19, 2023

(54) PAINTER EDGER TOOL

(71) Applicant: Daniel Patrick Kay, Portage, MI (US)

(72) Inventor: Daniel Patrick Kay, Portage, MI (US)

( * ) Notice: Subject to any disclaimer, the term of this patent is extended or adjusted under 35 U.S.C. 154(b) by 385 days.

(21) Appl. No.: 17/170,145

(22) Filed: Feb. 8, 2021

(65) Prior Publication Data

US 2021/0244174 A1 Aug. 12, 2021

Related U.S. Application Data

(60) Provisional application No. 62/975,431, filed on Feb. 12, 2020.

(51) Int. Cl.

| | |
|---|---|
| ***B05C 17/00*** | (2006.01) |
| ***A46B 5/00*** | (2006.01) |
| ***A46B 9/00*** | (2006.01) |
| ***A46B 17/08*** | (2006.01) |

(52) U.S. Cl.

CPC ..... *A46B 17/08* (2013.01); *A46B 5/0095* (2013.01); *A46B 9/005* (2013.01); *B05C 17/00* (2013.01); *A46B 2200/202* (2013.01)

(58) Field of Classification Search

CPC ..... A46B 5/0095; A46B 9/005; A46B 17/00; A46B 17/08; A46B 2200/202; B44D 3/00; B05C 17/00; B05C 17/12

USPC ..... 15/248.1, 246, 159.1–160

See application file for complete search history.

(56) References Cited

U.S. PATENT DOCUMENTS

| | | | | |
|---|---|---|---|---|
| 2,821,734 A * | 2/1958 | Carrabine | ..... | B44D 3/225 15/248.1 |
| 3,722,019 A * | 3/1973 | Magnien | ..... | A46B 11/001 15/210.1 |
| 2013/0047358 A1* | 2/2013 | Shafer | ..... | A46B 9/10 15/114 |

* cited by examiner

*Primary Examiner* — Laura C Guidotti
*Assistant Examiner* — Sharonda T Felton
(74) *Attorney, Agent, or Firm* — Larry E. Henneman, Jr.; Henneman & Associates, PLC

(57) ABSTRACT

A painter edger tool includes a base structure, a handle, an applicator, and a guard. In a particular embodiment, the base structure includes a first side edge and a second side edge. The guard is configured to be transitioned from a first position adjacent the first side edge, to a second position away from the first side edge, and to a third position adjacent the second side edge. In a more particular embodiment, the painter edger tool further includes a biasing member that urges the guard against a work surface when the applicator is advanced toward the work surface.

30 Claims, 12 Drawing Sheets

$\Theta_2 = 90^o$ $\Theta_4 > 90^o$

PAINTER EDGER TOOL

This application claims the benefit of priority of U.S. Provisional Patent Application Ser. No. 62/975,431, filed Feb. 12, 2020 by the same inventor and entitled "Adjustable Paint Edger Tool For Cutting In Edges And Corners," which is incorporated herein by reference in its entirety.

BACKGROUND OF THE INVENTION

Field of the Invention

This invention relates generally to painting, and more particularly to a tool for painting work surface edges and corners.

Description of the Background Art

Painting along edges (e.g., ceiling to wall interfaces, trim edges, etc.) has long been a challenging task for painters. Doing so typically requires a skilled painter with a steady hand. Even when the painter is skilled, painting along edges is a time consuming, difficult task, and can sometimes result in unwanted paint on adjacent surfaces.

In an effort to simplify the process of painting along edges, several tools and techniques have been developed over the years. For example, it is common for painters to apply tape along an edge before applying the paint. The edge of the tape is then painted with a brush such that when the tape is removed, a straight paint line is left behind. One challenge with using painter's tape is that it is time consuming and requires special tape that is relatively expensive. As another example, it is common for painters to use large, flat blades (e.g. putty knife) to temporarily cover portions of a work surface that are not intended to be painted. By painting along the linear edge of the blade, a straight paint line is achieved because the non-work surface behind the blade is protected while the work surface remains exposed. One challenge with using such blades is that they are relatively expensive and time consuming to use. Another challenge is that such blades require constant cleaning.

Edging tools have also been developed. An example type of edging tool includes a pad and a pair of wheels to keep the pad at a constant distant from an adjacent surface. However, paint from the pad can still spread onto the adjacent surface. Also, if the wheels get paint on them, they can leave unwanted paint tracks on the adjacent surface.

What is needed, therefore, is a tool that allows a painter to achieve straight paint lines in a more precise, time efficient, and less expensive manner.

SUMMARY

The present invention overcomes the problems associated with the prior art by providing a painter edger tool with a movable guard. The invention facilitates making clean, straight paint edges quickly and with minimal skill and/or effort.

An example paint edger tool includes a base structure, a handle, an applicator, and a guard. The base structure has a top surface, an opposite bottom surface, and a first side edge extending between the top surface and the bottom surface. The handle is coupled to the top surface of the base structure. The applicator has a top portion and an opposite bottom portion. The top portion of the applicator is coupled to the bottom surface of the base structure. The bottom portion of the applicator is configured to carry paint, to slide across a work surface, and to apply the paint to the work surface. The guard is movably coupled to the base structure and includes a wall, which has a bottom edge configured to slidably engage the work surface. The guard is movable between a first position, wherein the wall is disposed adjacent the first side edge of the base structure, and a second position wherein the wall is raised above the applicator.

An example painter edger tool additionally includes a biasing member. The biasing member can be coupled to the guard, and can be configured to urge the bottom edge of the wall against the working surface when the applicator contacts the working surface. The biasing member can allow movement of the guard relative to the base structure responsive to a user pressing the base structure and/or the attached applicator against the work surface.

In a particular example painter edger tool, the applicator includes a central portion and a first edge portion. The first edge portion is disposed along the first side edge of the base structure. The first edge portion of the applicator can include a top portion and an opposite bottom portion. The top portion of the first edge portion of the applicator can be coupled to the base structure, and the bottom portion of the first edge portion of the applicator is configured to carry paint, to slide across the work surface, and to apply paint to the work surface. The distance between the bottom edge of the wall and the base structure can be greater than the distance between the bottom portion of the first edge portion of the applicator and the base structure when the painter edger tool is not being urged against the work surface. In addition, the distance between the bottom edge of the wall and the base structure can be the same as the distance between the bottom portion of the first edge portion of the applicator and the base structure when the painter edger tool is being urged against the work surface. The distance between the bottom portion of the first edge portion of the applicator and the base structure can also be greater than the distance between the bottom portion of the central portion of the applicator and the base structure when the painter edger tool is not being urged against the work surface. In addition, the distance between the bottom portion of the first edge portion of the applicator and the base structure can be the same as the distance between the bottom portion of the central portion of the applicator and the base structure when the painter edger tool is being urged against the work surface.

In a particular example painter edger tool, the central portion of the applicator can be separate from the first edge portion of the applicator. For example, the central portion of the applicator can be removably attached to the base structure, and the edge portion of the applicator can be permanently fixed to the base structure. In a more particular example painter edger tool, the central portion of the applicator can include a removable pad, and the first edge portion of the applicator can include a brush permanently fixed to the base structure.

In an example painter edger tool, the applicator can include a second edge portion, including a top portion and an opposite bottom portion. The base structure can include a second edge extending between the top surface of the base structure and the bottom surface of the base structure. The top portion of the second edge portion of the applicator can be coupled to the base structure along the second edge of the base structure. The bottom portion of the second edge portion of the applicator can be configured to carry paint, to slide across the work surface, and to apply the paint to the work surface. The wall of the guard can be disposed adjacent the first edge portion of the applicator and away from the second edge portion of the applicator when the guard is in a first position. The guard can also be movable to another position, wherein the wall of the guard is disposed adjacent the second edge portion of the applicator and away from the first edge portion of the applicator.

In an example painter edger tool, the first edge portion of the applicator extends along a first direction, and the second edge portion of the applicator extends along a second direction that is substantially perpendicular to the first direction. Optionally, the first direction and the second direction can intersect at some acute angle.

In an example painter edger tool, the central portion of the applicator has a height measured along a direction perpendicular to the bottom surface of the base structure. The first edge portion of the applicator also has a height measured along the direction perpendicular to the bottom surface of the base structure, and the second edge portion of the applicator has a height measured along the direction perpendicular to the bottom surface of the base structure. The height of the first edge portion of the applicator and the height of the second edge portion of the applicator can be greater than the height of the central portion of the applicator when the applicator is not being urged against the work surface. In addition, the first edge portion of the applicator and the second edge portion of the applicator can be compressible, whereby the height of the first edge portion of the applicator and the height of the second edge portion of the applicator can be the same as the height of the central portion of the applicator when the applicator is being urged against the work surface.

In an example painter edger tool, the first side edge can include a linear portion. The base structure can also include a second side edge, and the second side edge can include a linear portion. The linear portion of the first side edge can be disposed at an angle with respect to the linear portion of the second side edge, and the guard can be movable to a third position, wherein the wall is disposed adjacent the second side edge. The guard can be rotatable about a point defined by the intersection of a first line and a second line. The first line intersects the middle of the linear portion of the first side edge at a right angle, and the second line intersects the middle of the linear portion of the second side edge at a right angle. The linear portion of the first side edge can be disposed at a substantially right angle with respect to the linear portion of the second side edge.

In an example painter edger tool, the bottom edge of the wall of the guard has a length, and the length of the bottom edge of the wall of the guard can be greater than the length of the first side edge of the base structure. The base structure can further include a second side edge extending between the top surface of the base structure and the bottom surface of the base structure. The second side edge of the base structure has a length, and the length of the bottom edge of the wall of the guard is also greater than the length of the second side edge of the base structure.

In a particular example painter edger tool, the guard includes a pressing surface. The guard can be coupled to the base structure to facilitate transition from the first position to the second position (or other positions) responsive to force being applied to the pressing surface of the guard. In addition, the guard can rotate at least partially about a fulcrum when the bottom edge of the wall is urged against the work surface, with or without applying force to the pressing surface.

Another example paint edger tool includes a base structure, an applicator, a guard, and a biasing member. The base structure can have a top surface, an opposite bottom surface, and a first side edge extending between the top surface and the bottom surface. The applicator can have a top portion, an opposite bottom portion, and a first side. The top portion of the applicator can be coupled to the bottom surface of the base structure, and the bottom portion of the applicator can be configured to carry paint, to slide across a work surface, and to apply the paint to the work surface. The guard can be movably coupled with respect to the applicator and can include a wall. The wall can have a bottom edge configured to slidably engage the work surface. The guard can also be movable between a first position, wherein the wall is disposed adjacent the first side of the applicator, and a second position wherein the wall is farther away from the first side edge of the applicator. The biasing member (e.g., a spring) can be coupled to urge the guard toward the first position.

Another example painter edger tool includes a base structure, a brush, a guard, and a biasing member. The base structure can have a top portion, an opposite bottom portion, and a first side portion disposed between the top portion and the bottom portion. The bottom portion can include a bottom surface of the base structure, and the bottom surface can face in a first direction. The brush can have a top portion and an opposite bottom portion. The top portion of the brush can be coupled to the bottom portion of the base structure. The bottom portion of the brush can be configured to slide across a work surface to apply paint thereto. The guard can be movably coupled to the base structure and can include a wall disposed adjacent the first side portion of the base structure. The wall can have a bottom surface configured to slidably engage the work surface. The biasing member can be coupled to the guard and can be configured to urge the bottom surface of the wall against the working surface responsive to advancing the brush toward the working surface. The wall of the guard can be configured to move relative to the base structure responsive to urging the base structure toward the work surface.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a painter edger tool having a brush and an integral edge guard. In the following description, numerous specific details are set forth (e.g., specific materials, component dimensions, etc.) in order to provide a thorough understanding of the invention. Those skilled in the art will recognize, however, that the invention may be practiced apart from these specific details. In other instances, details of well-known manufacturing practices (e.g., sheet metal bending, material cutting, etc.) and components have been omitted, so as not to unnecessarily obscure the present invention.

Figure 1:
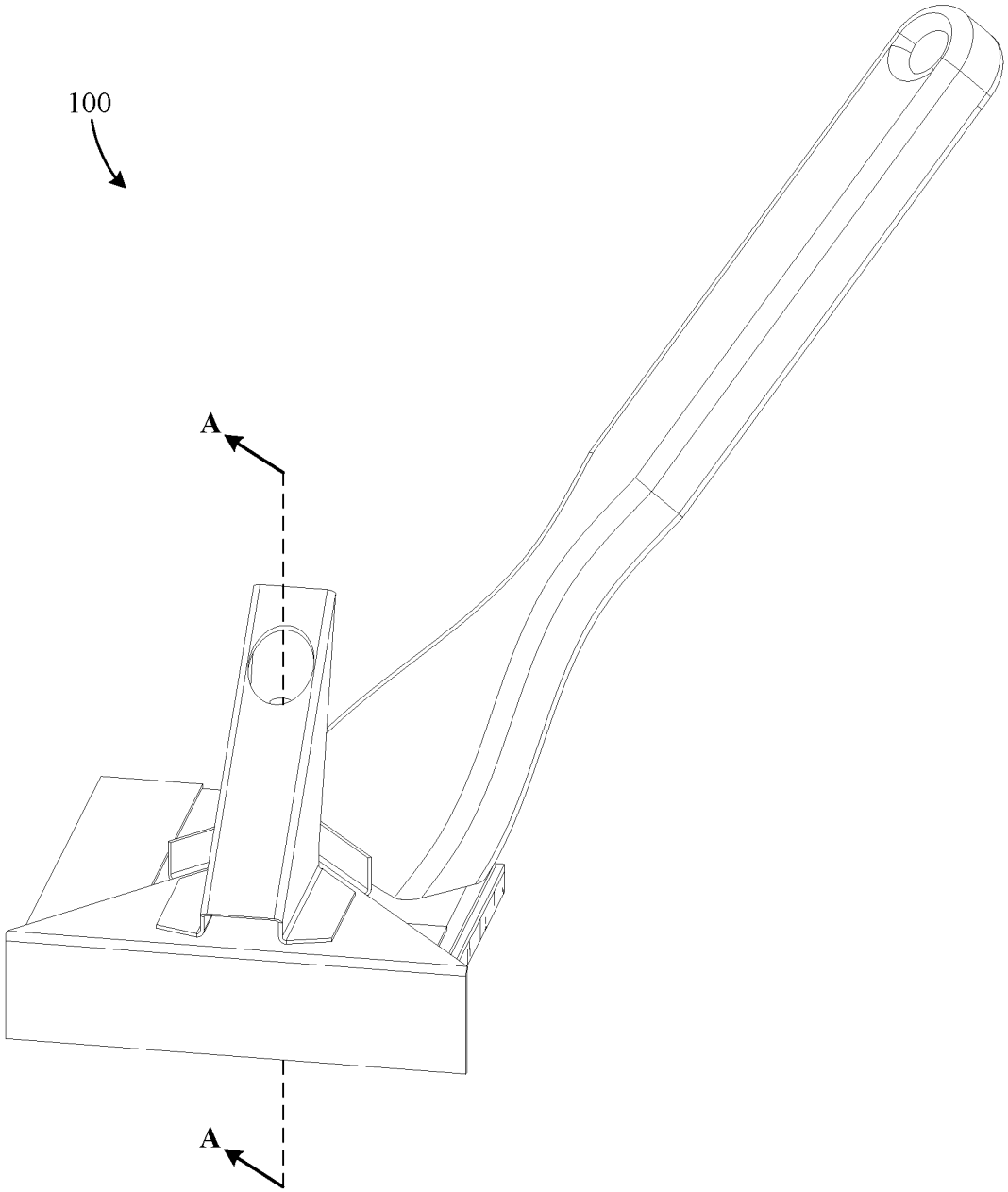
FIG. 1 is a perspective view of an example painter edger tool.

FIG. 1 shows a perspective view of a painter edger tool 100 according to one embodiment of the present invention. As will be described with reference to FIGS. 6A-6C, tool 100 is ambidextrous in that it can be used by either the left or right hand to paint straight lines along edges by a simple configuration adjustment. The adjustment can be made in the middle of a paint stroke using a single finger of the same hand holding tool 100. This allows the painter to paint along two intersecting surfaces and change direction in a single stroke. Generally, tool 100 is dipped into a shallow pool of paint, to saturate an applicator (not visible in the view of FIG. 1) between each stroke or series of strokes similar to a traditional paint brush.

It should be noted that the term "applicator" as used herein, broadly refers to any type of paint application materials and/or device such as, for example, bristle brushes, sponges, foam pads, fabric pads, etc. Likewise, the term "paint" broadly refers to any type of liquid that is applied to work surfaces. Such liquids include, but are not limited to, paints, primers, stains, polyurethanes, varnishes, and so on.

Figure 2:
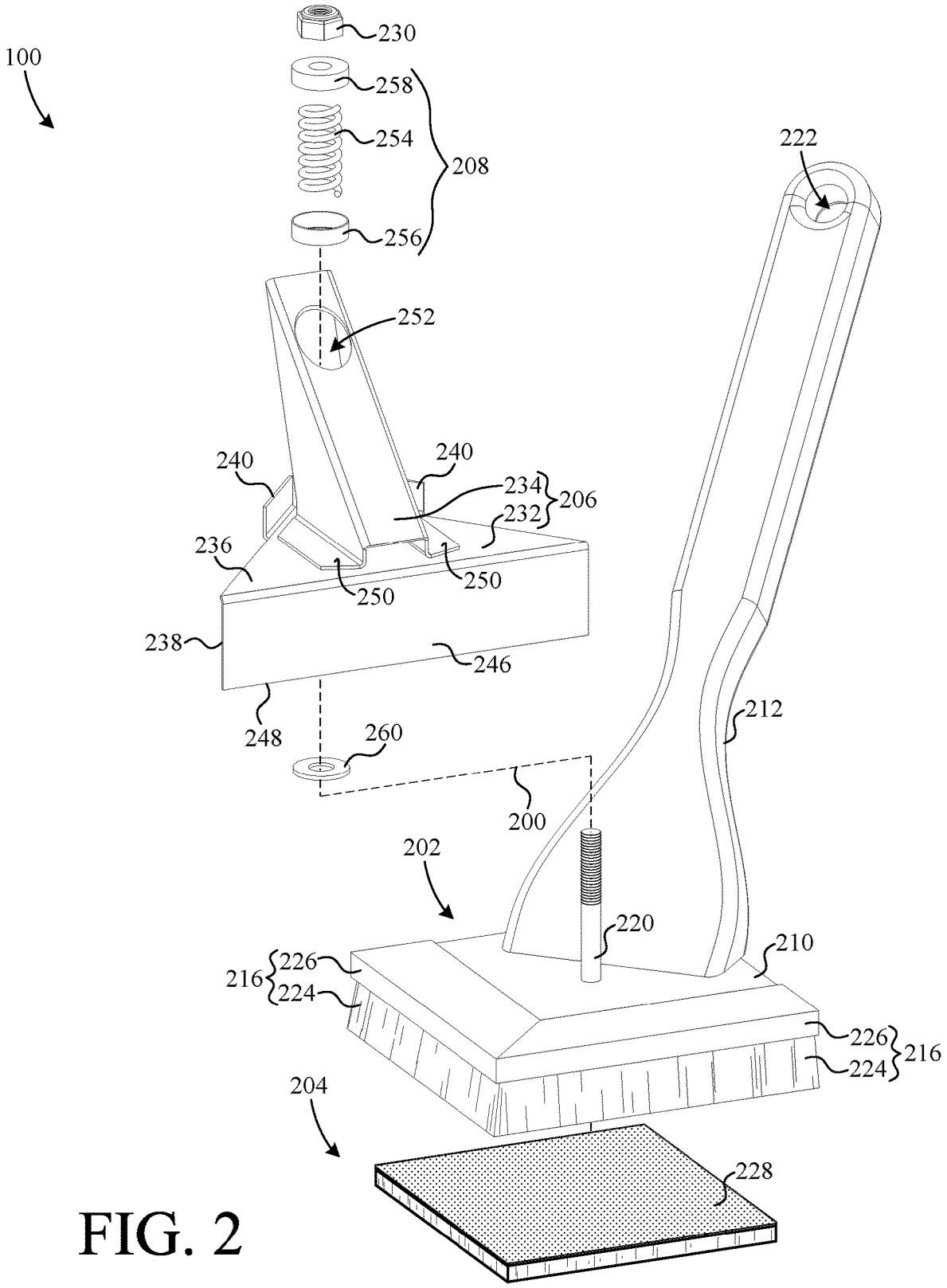
FIG. 2 is an exploded perspective view of the painter edger tool of FIG. 1.

FIG. 2 shows a perspective view of tool 100 partially exploded along an axis 200. Tool 100 includes a base assembly 202, a first applicator 204, a guard 206, and a biasing assembly 208. Applicator 204 is removably coupled to the bottom of base assembly 202, and guard 206 and biasing assembly 208 are coupled to the top of base assembly 202.

Base assembly 202 includes a base structure 210, a handle 212, a set of screws (not visible), an applicator 216, a loop substrate 218 (visible in FIG. 4), and a threaded post 220. Base structure 210 is formed from a substantially square plate of Acrylonitrile butadiene styrene (ABS) plastic. Handle 212 is mounted to the top surface of base structure 210 via the screws (not visible), which are screwed up through from the bottom surface of base structure 210 and then into the bottom of handle 212. In the example embodiment, handle 212 is formed from wood and is mounted at a forty five degree angle with respect to the linear sides of base structure 210. As shown, handle 212 includes an aperture 222 to facilitate the hanging of tool 100 from a wall peg and to facilitate the attachment of handle 212 to a tether if desired by the user.

Applicator 216 includes two, perpendicular, linear rows of bristles 224, each fixed in a respective aluminum frame 226. Loop substrate 218 (not visible in FIG. 2) is fixed to the bottom surface of base assembly 202 and is configured to be removably attached to a complementary hook substrate 228 of applicator 204. Together, loop substrate 218 and hook substrate 228 facilitate the removable attachment of applicator 204 to base assembly 202. This allows applicator 204 to be easily replaced after it becomes worn.

Applicator 204 is a substantially square section of brush material having a plane of bristles on the bottom and having hook substrate 228 on the opposite top. The bottom plane of bristles forms a planar brush that functions to soak up paint and release the paint onto a work surface. Hook substrate 228 and loop substrate 218, together, form a hook and loop fastener for attaching and detaching applicator 204 from base assembly 202.

Guard 206 is movably attached to base structure 202 via threaded post 220 and a nut 230. Guard 206 includes base 232 and an upright pressing structure 234. Base 232 includes a generally planar top portion 236, a generally planar wall 238 extending down from top portion 236, and two tabs 240 extending upwardly from top portion 236. Top portion 236 is disposed generally parallel to the top surface of base structure 210 when tool 100 is assembled and not in use.

Figure 3:
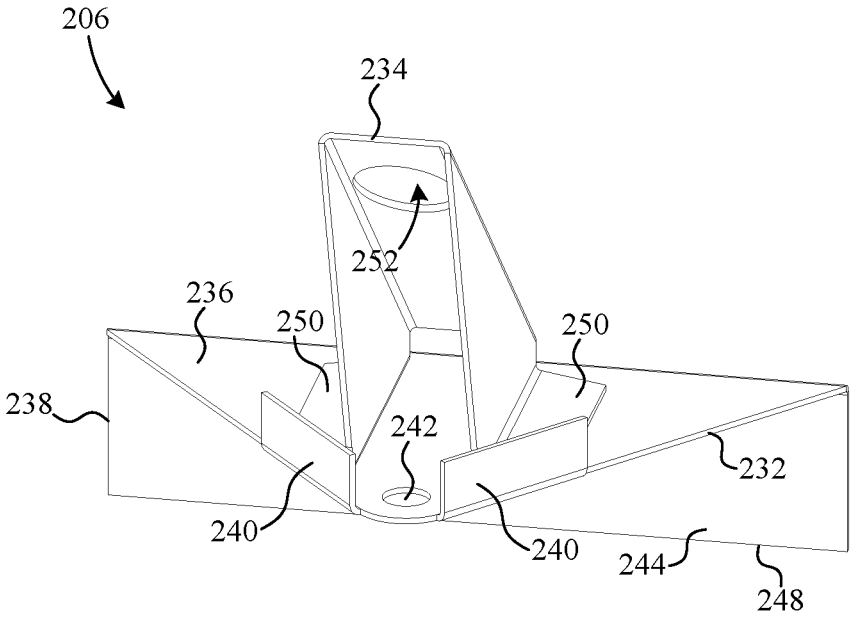
FIG. 3 is a rear perspective view of the guard of the painter edger tool of FIG. 1.

Referring to FIG. 2 and FIG. 3, top portion 236 includes an aperture 242 that is configured to receive threaded post 220 when tool 100 is assembled. Wall 238 includes an interior surface 244, an exterior surface 246, and a bottom edge/surface 248. Wall 238 extends downward from top portion 236 at an angle of approximately 105 degrees taken between interior surface 244 and the bottom surface of top portion 236. Tabs 240 are configured to selectively abut handle 212 to limit the angular displacement of guard 206 about screw 220. In this example, tabs 240 are disposed with a ninety degree angle therebetween, such that guard 206 has a range of motion that is approximately ninety degrees about post 220. Pressing structure/surface 234 facilitates the transition of guard 206 from one operating position to another operating position, using a finger of the same hand holding tool 100 to apply force to pressing structure 234. Pressing structure 234 includes two tabs 250 that are fixed to the top surface of top portion 236. Pressing structure 234 further includes an aperture 252 that simplifies the assembly of tool 100 by allowing a tool (i.e. socket) to access nut 230 through pressing structure 234. In this example, base 232 is formed from a first piece of sheet metal that is bent into shape, and pressing structure 234 is formed from a second piece of sheet metal that is bent into shape. Each of tabs 250 is tack welded to the top surface of top portion 236 such that guard 206 is a single rigid body structure.

Biasing assembly 208 is adapted to urge guard 206 down post 220 toward base structure 210, such that bottom surface 248 of wall 238 maintains a constant pressure against an underlying work surface (surface being painted) when applicator 204 and 224 are urged against the work surface. Biasing assembly 208 compresses slightly and allows bottom surface 248 to move into a position that is coplanar to the bottom surface of brush pad 204 and the bristles of applicator 224 when tool 100 is urged against a work surface. In this example embodiment, biasing assembly 208 is a coil spring 254 disposed between a bottom end cap 256 and a top end cap 258. Bottom end cap 256 includes a bottom portion that engages the top surface of top portion 236 of guard 206 and includes an opposite top portion that cradles and contains the bottom of spring 254. Top end cap 258 includes a top portion that engages the bottom surface of lock nut 230 and includes an opposite bottom portion that cradles and contains the top of spring 254. The farther lock nut 230 is threaded onto post 220, the greater the force that is required to lift bottom surface 248 of wall 238 toward the level of applicator 204 when tool 100 is urged against a work surface. Accordingly, the force required to advance bottom surface 248 of wall 238 toward applicator 204 when tool 100 is urged against a work surface is adjustable according to user preference.

The assembly of guard 206 and biasing assembly 208 with the rest of tool 100 is described as follows. First, a washer 260 is disposed around post 220 such that washer 260 rests on top of base structure 210. Then, post 220 is disposed through aperture 242 of top portion 236, such that the bottom surface of top portion 236 abuts the top surface of washer 260. Next, bottom end cap 256 is placed over post 220, such that the bottom portion of bottom end cap 256 abuts the top surface of top portion 236. Then, spring 254 is placed over post 220, so that spring 254 is seated in bottom end cap 256. Next, top end cap 258 is placed over post 220, so that the top of spring 254 is seated in the bottom of top end cap 258. Finally, lock nut 230 is threaded onto post 220 until a desired amount of compression is achieved in spring 254.

FIG. 3 shows a rear perspective view of guard 206 removed from base assembly 202.

Figure 4:
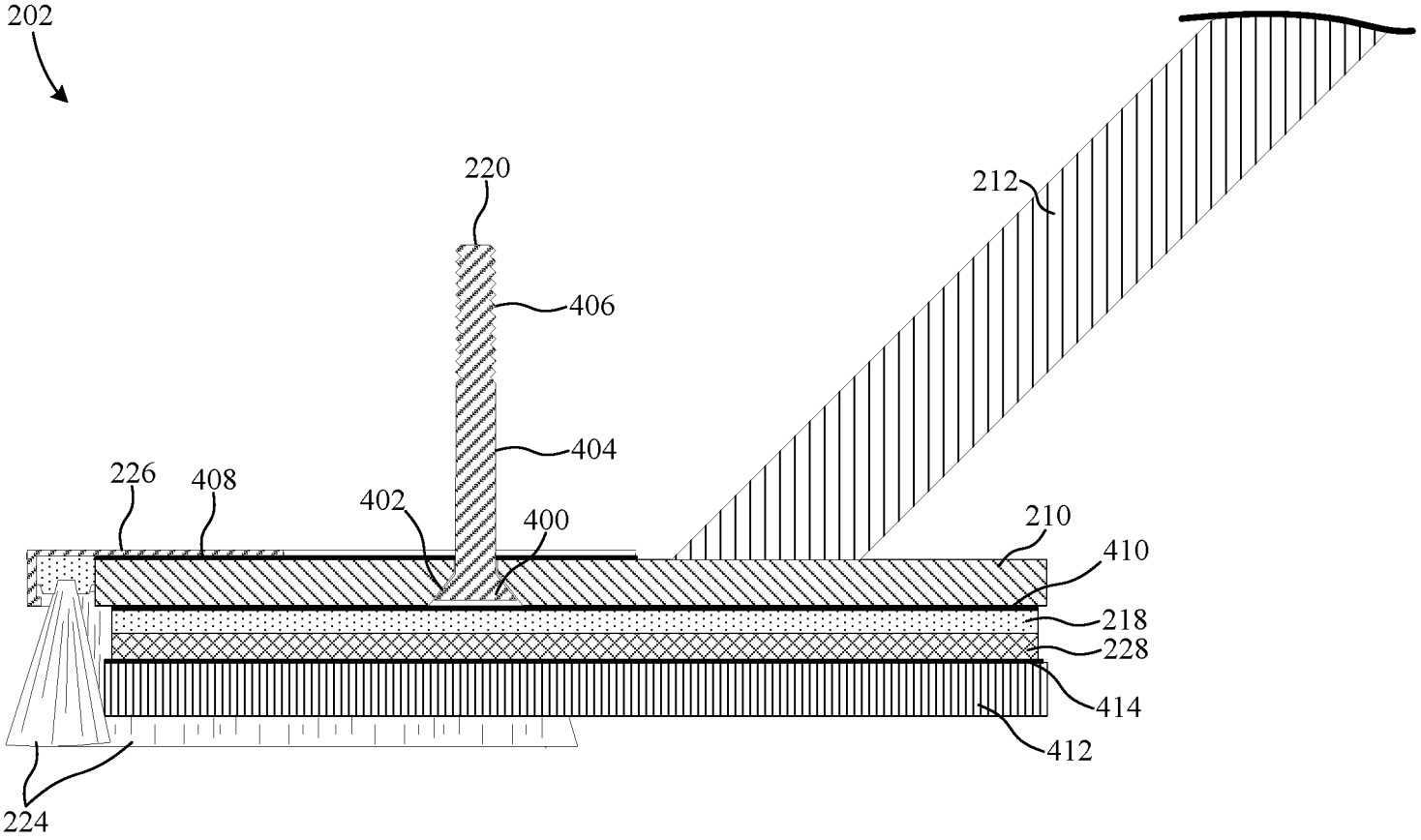
FIG. 4 is a cross sectional view of the painter edger tool of FIG. 1, taken along line A-A of FIG. 1.

FIG. 4 is a cross-sectional view of base assembly 202, taken along line A-A of FIG. 1. As shown, in this embodiment, post 220 is a bolt having a head 400 seated in a countersunk hole 402. Accordingly, post 220 has a countersink-type bolt head. Furthermore, post 220 includes a smooth cylindrical portion 404 disposed between head 400 and the threads 406 of post 220. Portion 404 is intentionally smooth and cylindrical so that the interior surface of guard 206, defining aperture 242, can rotate smoothly about post 220, and move up and down on post 220, without getting hung up on threads 406 and causing wear therebetween.

The various components of base assembly 202 and how they are coupled together are summarized as follows. Frame 226 is affixed to the top surface of base structure 210 by a first adhesive layer 408. Handle 212 is also affixed to the top surface of base structure 210, but is done so by a set of two screws (not visible) that are screwed through the bottom surface of base structure 210 and then into the bottom surface of handle 212. Loop substrate 218 is bonded to the rear surface of base structure 210 by a second adhesive layer 410, such that loop substrate 218 covers the heads of post 220 and the screws used to attach handle 212. Hook substrate 228 is bonded to the top surface of a bristle substrate 412 of applicator 204 by a third adhesive layer 414 such that applicator 204 can be removed by manually separating hook substrate 228 from loop substrate 218.

As shown, the bottoms of the bristles of applicator 224 extend below the bottoms of the bristles of bristle substrate 412. However, the bristles of applicator 224 are compressible and deflectable, so that when applicator 224 and bristle substrate 412 are urged against a work surface, they will be at substantially the same level. That is, when applying paint, the height of applicator 224 and the height of bristle substrate 412 will be substantially the same. Indeed, applicator 224 and bristle substrate 412 can work together as a single applicator, with bristle substrate 412 forming a central portion of the combined applicator and applicator 224 forming an edge portion of the combined applicator.

Figure 5:
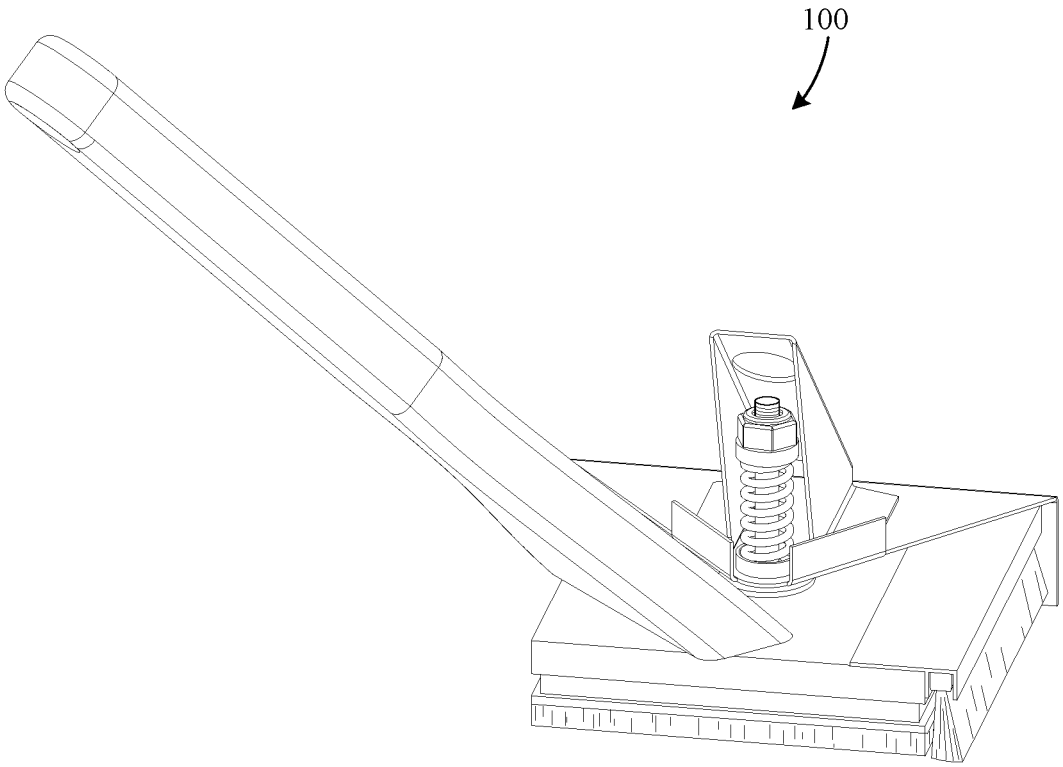
FIG. 5 is a rear perspective view of the painter edger tool of FIG. 1.

FIG. 5 shows a rear perspective view of tool 100 assembled.

Figure 6C:
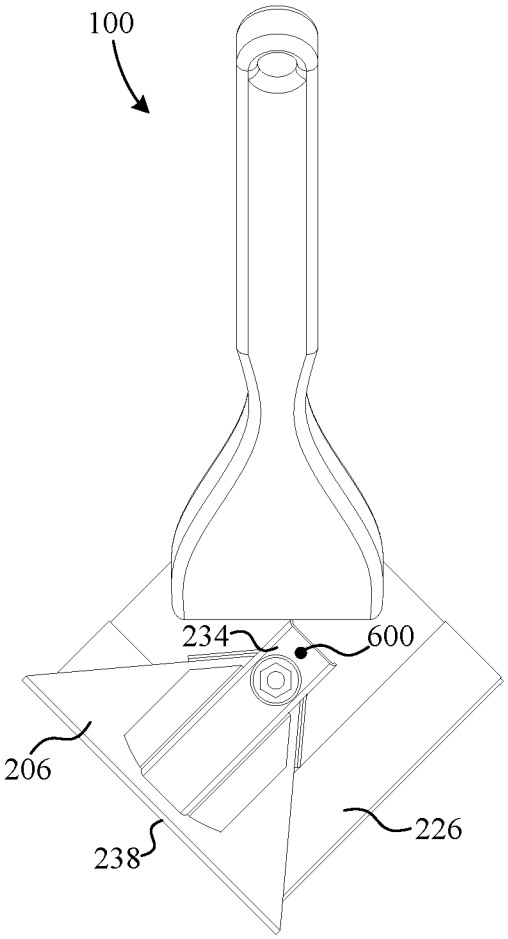
FIG. 6C is a top view of the painter edger tool of FIG. 1 in a second operating position.
Figure 6B:
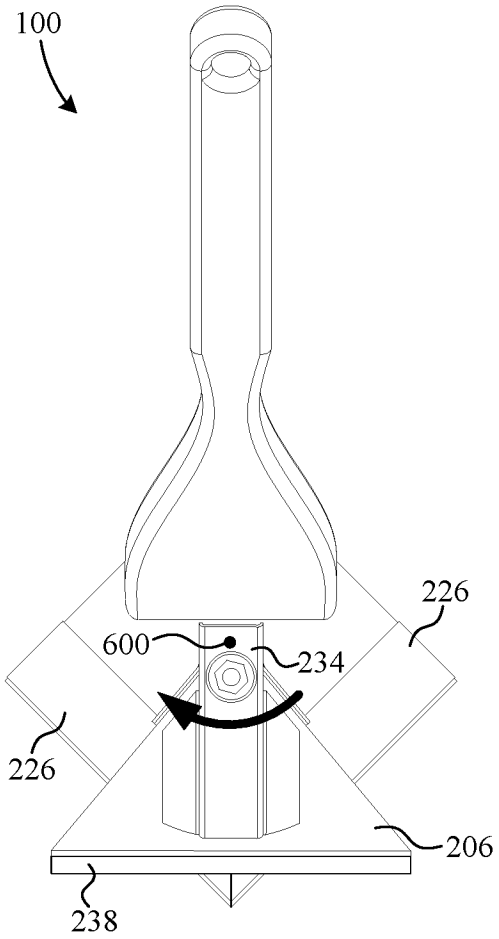
FIG. 6B is a top view of the painter edger tool of FIG. 1 transitioning from one operating position to a second operating position.
Figure 6A:
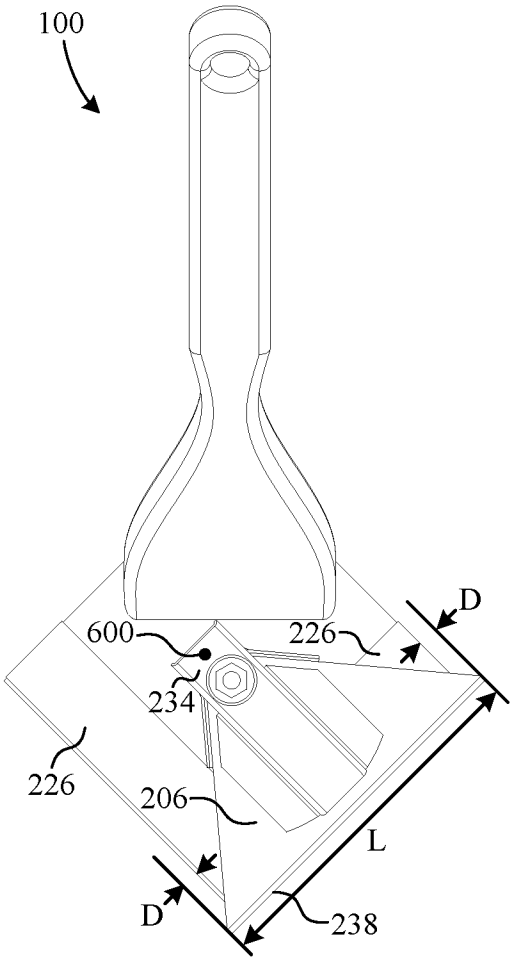
FIG. 6A is a top view of the painter edger tool of FIG. 1 in a first operating position.

FIGS. 6A-6C show respective top views of tool 100 transitioning from a first operating position to a second operating position. More specifically, FIG. 6A shows a top view of tool 100 in a first operating position, wherein guard 206 is positioned with wall 238 parallel and adjacent to a first one of the two linear rows of applicator 224. Accordingly, the aforementioned first one of the two linear rows of bristles of applicator 224 applies a straight line of paint on the underlying work surface on the interior side of wall 238, while the area of the underlying work surface on the opposite side of wall 238 (exterior side) remains free of paint as tool 100 is dragged along an edge adjacent the work surface. FIG. 6B illustrates the process of transitioning from the aforementioned first operating position illustrated in FIG. 6A to a second operating position illustrated in FIG. 6C. This transition can be done with the same hand holding tool 100. For example, guard 206 can be transitioned from the first operating position to the second operating position by pressing down on pressing structure 234 at a point 600 with the index finger until bottom surface 248 of wall 238 is raised sufficient to clear the top surface of frame 226. Then, with bottom surface 248 raised, the same index finger is used to rotate pressing structure 234 and, therefore, guard 206 about screw 220. Once wall 238 is rotated to a position parallel to the second of the two linear rows of bristles of applicator 224, pressing structure 234 is released, thereby positioning guard 206 in the second operating position illustrated in FIG. 6C. Of course, the aforementioned method can be reversed to return tool 100 back to the first operating position.

Raising wall 238 to a position above frame 226 also provides a useful way to apply paint to applicators 204 and 224, without getting paint on wall 238. That is, with wall 238 in a raised position, applicators 204 and 224 can be dipped into a shallow puddle of paint, without dipping wall 238 into the paint.

In this particular example, the two linear rows of bristles of applicator 224 are configured with ninety degrees therebetween. However, in alternate embodiments, the angle between the two linear rows of bristles can be greater or smaller than ninety degrees.

As shown in FIG. 6A, the side edges of wall 238 extend beyond each edge of respective edges of frame 226 and applicator 224 by a distance of D=0.25 inches. In other words, the length L of wall 238 is greater than the length of each row of bristles of applicator 224. More specifically, L is equal to the row length of one of the rows of bristles of applicator 224+2(D). This is to prevent paint saturated/deflected bristles of applicator 224 from extending beyond wall 238 when tool 100 is urged against a work surface. Otherwise, when bristles of applicator 224 deform, they could inadvertently extend beyond the intended paint line and leave paint marks where the painter does not intend to paint.

Figure 7:
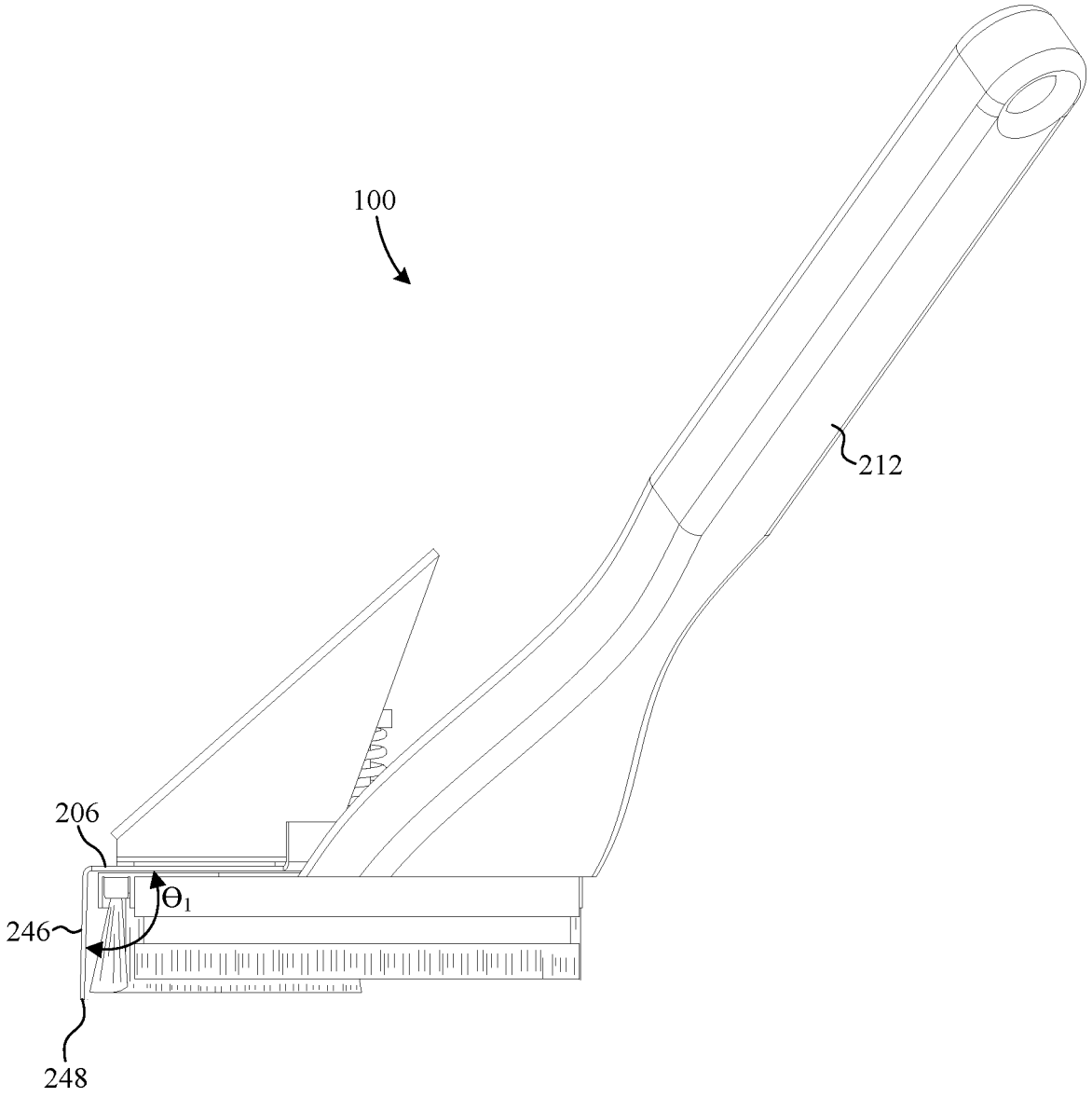
FIG. 7 is a side plan view of the painter edger tool of FIG. 1.

FIG. 7 shows a side view of tool 100 in the first operating position shown in FIG. 6A. In this particular example, the angle $\theta_1$ is approximately 105°. This allows bottom edge/surface 248 to slidably contact a work surface edge, while minimizing contact between exterior surface 246 and any imperfections of a wall adjacent the work surface edge such as, for example, bumps (e.g., hardended drywall mud, glue blobs, nails, etc.) and divots. Such imperfections could otherwise contact exterior surface 246 and cause tool 100 to deviate from a straight paint line along the work surface edge as tool 100 is dragged past the imperfections.

Figure 8:
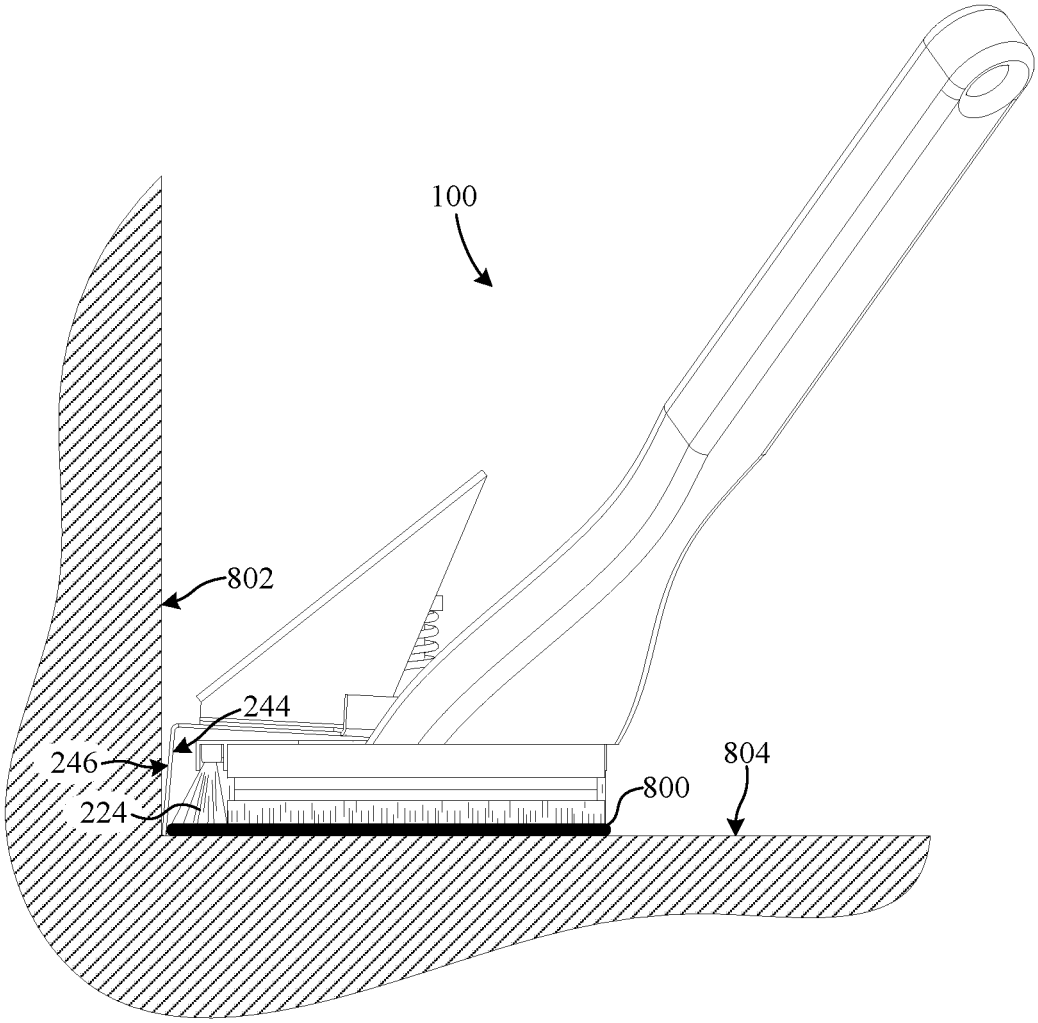
FIG. 8 is a side plan view of the painter edger tool of FIG. 1 applying paint to a work surface.

FIG. 8 shows a side view of tool 100 in the first operating position wherein it is being used to apply paint 800 along a work surface 804 oriented ninety degrees from a non-work surface 802 (e.g., an adjacent wall). In this example, tool 100 is being dragged in a direction toward the viewer. As previously mentioned, exterior surface 246 is angled slightly with respect to non-work surface 802 to avoid contacting imperfections in non-work surface 802. It should also be noted that the planar top surface of guard 206 is also slightly angled with respect to the planar top surface of base structure 210 when bottom surface is urged against a work surface 804. This is because guard 206 rocks back slightly (against the force of biasing member 254 (FIG. 2)) at a fulcrum point between guard 206 and the top surface of base structure 210. This further minimizes contact between exterior surface 246 and imperfections in non-work surface 802. As shown, bristles of applicator 224 spread sufficiently to make contact with the interior surface 244 of wall 238 when tool 100 is urged against work surface 804. Of course, wall 238 also functions as a barrier to prevent saturated bristles 224 from contacting non-work surface 802.

Figure 9:
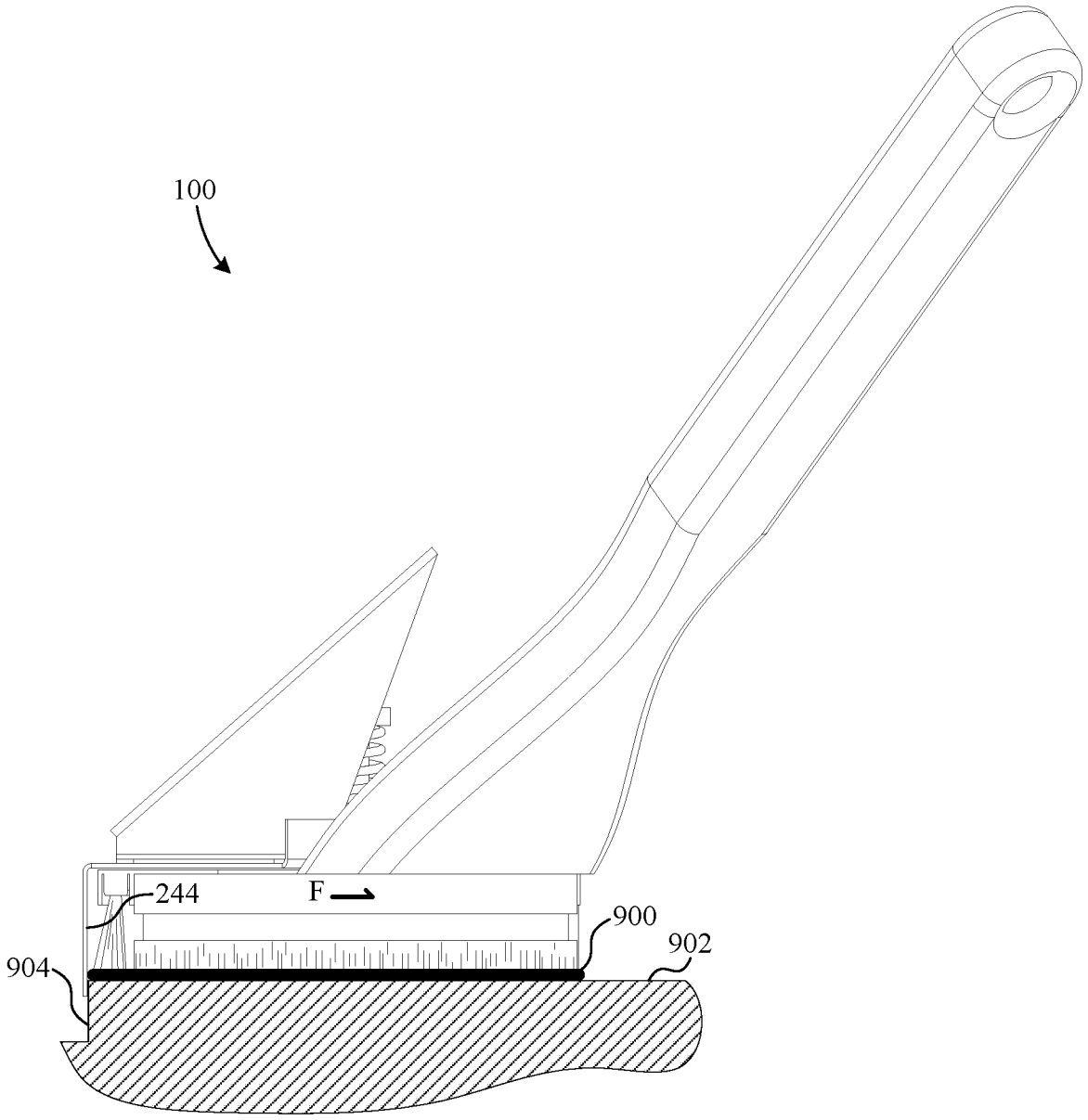
FIG. 9 is a side plan view of the painter edger tool of FIG. 1 applying paint to another work surface.

FIG. 9 shows a side view of tool 100 in the first operating position, wherein it is being used to apply paint 900 along a work surface 902 oriented two hundred and seventy degrees from a non-work surface 904. In this example, tool 100 is being dragged in a direction toward the viewer. In this particular application, interior surface 244 is slidably engaging non-work surface 904, and guard 206 is not being urged upward along screw 220. In sliding interior surface 244 along non-work surface 904, a slight force F in the direction indicated by the arrow maintains engagement therebetween.

Figure 10:
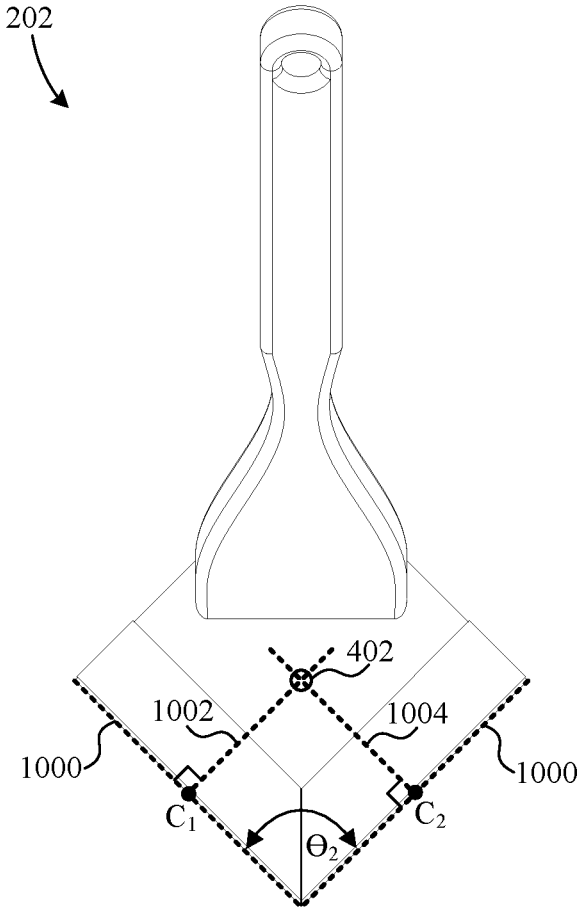
FIG. 10 is a top view of the base assembly of the painter edger tool of FIG. 1.

FIG. 10 shows a top view of base assembly 202. In the example embodiment, side edges form a 90 degree angle therebetween. The position of hole 402 and, therefore, the rotational axis of guard 206 is disposed at a point defined by the intersection of a first line 1002 and a second line 1004. First line 1002 extends at a right angle from the center point $C_1$ of the first one of edges 1000 toward the center of hole 402. Likewise, second line 1004 extends at a right angle from the center point $C_2$ of the second one of edges 1000 toward the center of hole 402. This allows the outer edges of wall 238 to extend evenly past the opposing ends of side edges 1000. As will be shown in upcoming FIGS. 11-12, the aforementioned geometric relationships defining the location of hole 402 apply even when edges 1000 do not form a degree angle.

Figure 11:
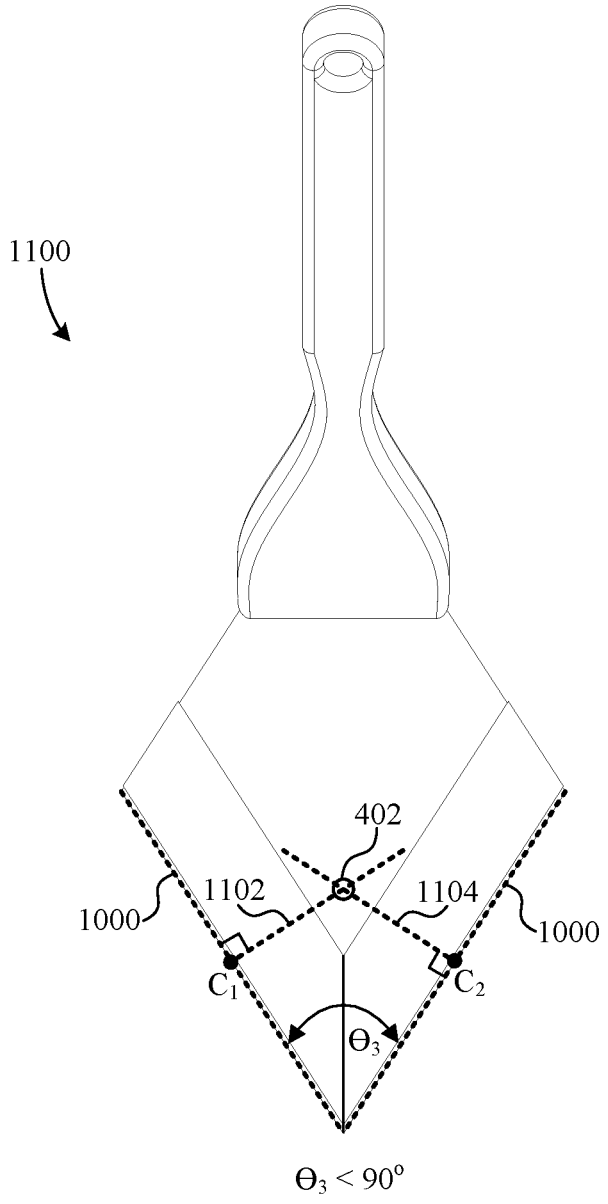
FIG. 11 is a top view of an alternate base assembly.

FIG. 11 shows a top view of an alternate base assembly 1100. Base assembly 1100 is substantially similar to base assembly 202, except that the angle between edges 1000 in base assembly 1100 is acute rather than 90 degrees. Therefore, substantially similar components will be denoted with like reference numbers and not explained in detail to avoid redundancy.

The position of hole 402 and, therefore, the rotational axis of guard 206 is disposed at a point defined by the intersection of a first line 1102 and a second line 1104. First line 1102 extends at a right angle from the center point C1 of the first one of edges 1000 toward the center of hole 402. Likewise, second line 1104 extends at a right angle from the center point C2 of the second one of edges 1000 toward the center of hole 402. This allows the outer edges of wall 238 to extend evenly past the opposing ends of side edges 1000.

Figure 12:
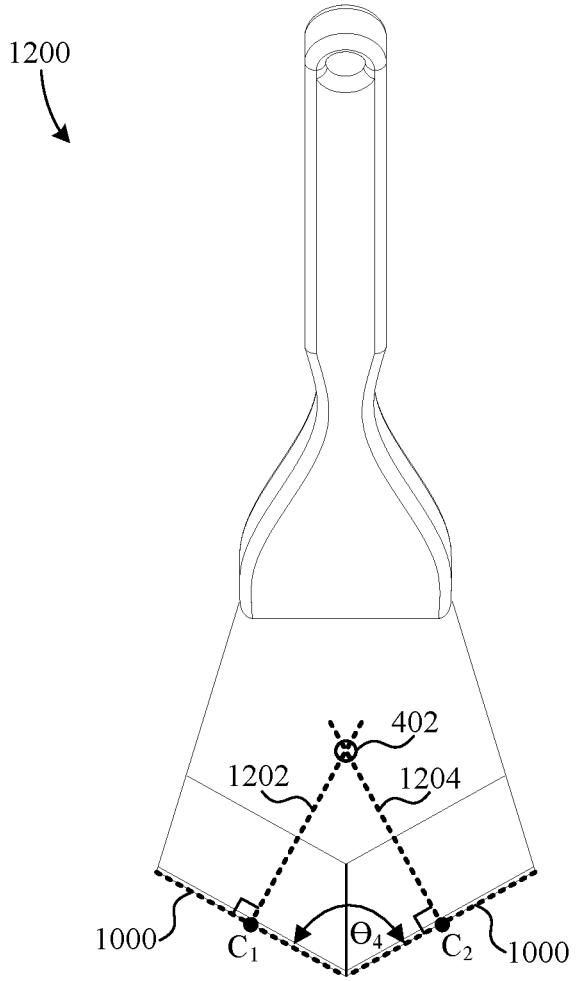
FIG. 12 is a top view of another alternate base assembly.

FIG. 12 shows a top view of an alternate base assembly 1200. Base assembly 1200 is substantially similar to base assembly 202, except that the angle between edges 1000 in base assembly 1200 is obtuse.

The position of hole 402 and, therefore, the rotational axis of guard 206 is disposed at a point defined by the intersection of a first line 1202 and a second line 1204. First line 1202 extends at a right angle from the center point C1 of the first one of edges 1000 toward the center of hole 402. Likewise, second line 1204 extends at a right angle from the center point C2 of the second one of edges 1000 toward the center of hole 402. This allows the outer edges of wall 238 to extend evenly past the opposing ends of side edges 1000.

The description of particular example embodiments of the present invention is now complete. Many of the described features may be substituted, altered or omitted without departing from the scope of the invention. For example, alternate materials (e.g., plastic, metal, etc.), may be substituted for the wood used to form the handle. As another example, alternate types of biasing members (e.g., leaf spring, resilient material, and so on) could be substituted for the coil spring of the example embodiment. As yet another example, alternate removable fasteners (e.g., snaps, magnets, palm tree hooks, mushroom hooks, duel lock fasteners, adhesives, and so on.), may be substituted for the hook and loop fasteners shown in the example embodiments. These and other deviations from the particular embodiments shown will be apparent to those skilled in the art, particularly in view of the foregoing disclosure.

I claim:

1. A paint edger tool comprising:

a base structure having a top surface, an opposite bottom surface, and a first side edge extending between said top surface and said bottom surface;

a handle coupled to said top surface of said base structure;

an applicator having a top portion and an opposite bottom portion, said top portion of said applicator being coupled to said bottom surface of said base structure, said bottom portion of said applicator being configured to carry paint, to slide across a work surface, and to apply said paint to said work surface; and a guard movably coupled to said base structure, said guard including a wall, said wall having a bottom edge configured to slidably engage said work surface, said guard movable between a first position, wherein said wall is disposed adjacent said first side edge of said base structure, and a second position wherein said wall is raised above said applicator; and wherein said first side edge includes a linear portion;

said base structure further includes a second side edge;

said second side edge includes a linear portion;

said linear portion of said first side edge is disposed at an angle with respect to said linear portion of said second side edge;

said guard is movable to a third position, wherein said wall is disposed adjacent said second side edge; and said guard is rotatable about a point defined by an intersection of a first line and a second line, said first line intersecting a middle of said linear portion of said first side edge at a right angle, said second line intersecting a middle of said linear portion of said second side edge at a right angle.

2. The painter edger tool of claim 1, further comprising:

a biasing member coupled to said guard, said biasing member being configured to urge said bottom edge of said wall against said working surface when said applicator contacts said working surface; and wherein said biasing member allows movement of said guard relative to said base structure responsive to a user pressing said base structure against said work surface.

3. The painter edger tool of claim 1, wherein said applicator includes:

a central portion; and a first edge portion disposed along said first side edge of said base structure.

4. The painter edger tool of claim 3, wherein:

said first edge portion of said applicator includes a top portion and an opposite bottom portion;

said top portion of said first edge portion of said applicator is coupled to said base structure;

said bottom portion of said first edge portion of said applicator is configured to carry paint, to slide across said work surface, and to apply paint to said work surface;

the distance between said bottom edge of said wall and said base structure is greater than the distance between said bottom portion of said first edge portion of said applicator and said base structure when said painter edger tool is not being urged against said work surface; and the distance between said bottom edge of said wall and said base structure is the same as the distance between said bottom portion of said first edge portion of said applicator and said base structure when said painter edger tool is being urged against said work surface.

5. The painter edger tool of claim 4, wherein:

the distance between said bottom portion of said first edge portion of said applicator and said base structure is greater than the distance between said bottom portion of said central portion of said applicator and said base structure when said painter edger tool is not being urged against said work surface; and the distance between said bottom portion of said first edge portion of said applicator and said base structure is the same as the distance between said bottom portion of said central portion of said applicator and said base structure when said painter edger tool is being urged against said work surface.

6. The painter edger tool of claim 5, wherein:

said central portion of said applicator is separate from said first edge portion of said applicator; and said central portion of said applicator is removably attached to said base structure.

7. The painter edger tool of claim 6, wherein said edge portion of said applicator is permanently fixed to said base structure.

8. The painter edger tool of claim 3, wherein:

said applicator includes a second edge portion, said second edge portion having a top portion and an opposite bottom portion;

said base structure includes a second edge extending between said top surface of said base structure and said bottom surface of said base structure;

said top portion of said second edge portion of said applicator is coupled to said base structure along said second edge of said base structure;

said bottom portion of said second edge portion of said applicator is configured to carry paint, to slide across said work surface, and to apply said paint to said work surface;

said wall of said guard is disposed adjacent said first edge portion of said applicator and away from said second edge portion of said applicator when said guard is in said first position; and said guard is movable to a third position, wherein said wall of said guard is disposed adjacent said second edge portion of said applicator and away from said first edge portion of said applicator.

9. The painter edger tool of claim 8, wherein:

said first edge portion of said applicator extends along a first direction; and said second edge portion of said applicator extends along a second direction that is substantially perpendicular to said first direction.

10. The painter edger tool of claim 8, wherein:

said central portion of said applicator has a height measured along a direction perpendicular to said bottom surface of said base structure;

said first edge portion of said applicator has a height measured along said direction perpendicular to said bottom surface of said base structure;

said second edge portion of said applicator has a height measured along said direction perpendicular to said bottom surface of said base structure;

said height of said first edge portion of said applicator and said height of said second edge portion of said applicator are greater than said height of said central portion of said applicator when said applicator is not being urged against said work surface; and said first edge portion of said applicator and said second edge portion of said applicator are compressible, whereby said height of said first edge portion of said applicator and the height of said second edge portion of said applicator are the same as said height of said central portion of said applicator when said applicator is being urged against said work surface.

11. The painter edger tool of claim 3, wherein:

said central portion of said applicator includes a removable pad; and said first edge portion of said applicator includes a brush permanently fixed to said base structure.

12. The painter edger tool of claim 1, wherein said linear portion of said first side edge is disposed at a substantially right angle with respect to said linear portion of said second side edge.

13. The painter edger tool of claim 1, wherein:

said bottom edge of said wall of said guard has a length;

said length of said bottom edge of said wall of said guard is greater than the length of said first side edge of said base structure.

14. The painter edger tool of claim 13, wherein:

said second side edge extends between said top surface of said base structure and said bottom surface of said base structure;

said second side edge of said base structure has a length; and said length of said bottom edge of said wall of said guard is greater than said length of said second side edge of said base structure.

15. The painter edger tool of claim 1, wherein:

said guard includes a pressing surface, and said guard is coupled to said base structure to facilitate transition from said first position to said second position responsive to force being applied to said pressing surface of said guard.

16. The painter edger tool of claim 1, wherein said guard rotates at least partially about a fulcrum when said bottom edge of said wall is urged against said work surface.

17. A paint edger tool comprising:

a base structure having a top surface, an opposite bottom surface, and a first side edge extending between said top surface and said bottom surface;

a handle coupled to said top surface of said base structure;

an applicator having a top portion and an opposite bottom portion, said top portion of said applicator being coupled to said bottom surface of said base structure, said bottom portion of said applicator being configured to carry paint, to slide across a work surface, and to apply said paint to said work surface; and a guard movably coupled to said base structure, said guard including a wall, said wall having a bottom edge configured to slidably engage said work surface, said guard movable between a first position, wherein said wall is disposed adjacent said first side edge of said base structure, and a second position wherein said wall is raised above said applicator; and wherein said applicator includes a central portion;

said applicator includes a first edge portion disposed along said first side edge of said base structure;

said applicator includes a second edge portion, said second edge portion having a top portion and an opposite bottom portion;

said base structure includes a second edge extending between said top surface of said base structure and said bottom surface of said base structure;

said top portion of said second edge portion of said applicator is coupled to said base structure along said second edge of said base structure;

said bottom portion of said second edge portion of said applicator is configured to carry paint, to slide across said work surface, and to apply said paint to said work surface;

said wall of said guard is disposed adjacent said first edge portion of said applicator and away from said second edge portion of said applicator when said guard is in said first position; and said guard is movable to a third position, wherein said wall of said guard is disposed adjacent said second edge portion of said applicator and away from said first edge portion of said applicator;

said central portion of said applicator has a height measured along a direction perpendicular to said bottom surface of said base structure;

said first edge portion of said applicator has a height measured along said direction perpendicular to said bottom surface of said base structure;

said second edge portion of said applicator has a height measured along said direction perpendicular to said bottom surface of said base structure;

said height of said first edge portion of said applicator and said height of said second edge portion of said applicator are greater than said height of said central portion of said applicator when said applicator is not being urged against said work surface; and said first edge portion of said applicator and said second edge portion of said applicator are compressible, whereby said height of said first edge portion of said applicator and the height of said second edge portion of said applicator are the same as said height of said central portion of said applicator when said applicator is being urged against said work surface.

18. The painter edger tool of claim 17, further comprising:

a biasing member coupled to said guard, said biasing member being configured to urge said bottom edge of said wall against said working surface when said applicator contacts said working surface; and wherein said biasing member allows movement of said guard relative to said base structure responsive to a user pressing said base structure against said work surface.

19. The painter edger tool of claim 17, wherein:

said first edge portion of said applicator includes a top portion and an opposite bottom portion;

said top portion of said first edge portion of said applicator is coupled to said base structure;

said bottom portion of said first edge portion of said applicator is configured to carry paint, to slide across said work surface, and to apply paint to said work surface;

the distance between said bottom edge of said wall and said base structure is greater than the distance between said bottom portion of said first edge portion of said applicator and said base structure when said painter edger tool is not being urged against said work surface; and the distance between said bottom edge of said wall and said base structure is the same as the distance between said bottom portion of said first edge portion of said applicator and said base structure when said painter edger tool is being urged against said work surface.

20. The painter edger tool of claim 19, wherein:

the distance between said bottom portion of said first edge portion of said applicator and said base structure is greater than the distance between said bottom portion of said central portion of said applicator and said base structure when said painter edger tool is not being urged against said work surface; and the distance between said bottom portion of said first edge portion of said applicator and said base structure is the same as the distance between said bottom portion of said central portion of said applicator and said base structure when said painter edger tool is being urged against said work surface.

21. The painter edger tool of claim 20, wherein:

said central portion of said applicator is separate from said first edge portion of said applicator; and said central portion of said applicator is removably attached to said base structure.

22. The painter edger tool of claim 21, wherein said edge portion of said applicator is permanently fixed to said base structure.

23. The painter edger tool of claim 17, wherein:

said first edge portion of said applicator extends along a first direction; and said second edge portion of said applicator extends along a second direction that is substantially perpendicular to said first direction.

24. The painter edger tool of claim 17, wherein:

said central portion of said applicator includes a removable pad; and said first edge portion of said applicator includes a brush permanently fixed to said base structure.

25. The painter edger tool of claim 17, wherein:

said first side edge includes a linear portion;

said base structure further includes a second side edge;

said second side edge includes a linear portion;

said linear portion of said first side edge is disposed at an angle with respect to said linear portion of said second side edge; and said guard is movable to a third position, wherein said wall is disposed adjacent said second side edge.

26. The painter edger tool of claim 25, wherein said linear portion of said first side edge is disposed at a substantially right angle with respect to said linear portion of said second side edge.

27. The painter edger tool of claim 17, wherein:

said bottom edge of said wall of said guard has a length; and said length of said bottom edge of said wall of said guard is greater than the length of said first side edge of said base structure.

28. The painter edger tool of claim 27, wherein said base structure further includes a second side edge extending between said top surface of said base structure and said bottom surface of said base structure;

said second side edge of said base structure having a length; and said length of said bottom edge of said wall of said guard is greater than said length of said second side edge of said base structure.

29. The painter edger tool of claim 17, wherein said guard includes a pressing surface, and said guard is coupled to said base structure to facilitate transition from said first position to said second position responsive to force being applied to said pressing surface of said guard.

30. The painter edger tool of claim 17, wherein said guard rotates at least partially about a fulcrum when said bottom edge of said wall is urged against said work surface.

* * * * *